United States Patent [19]

Watson

[11] 4,294,548

[45] Oct. 13, 1981

[54] DRIVE ARRANGEMENT FOR CONCRETE MIXERS

[75] Inventor: Arthur Watson, Sellicks Beach, Australia

[73] Assignee: Lightburn & Co. Limited, Novar Gardens, Australia

[21] Appl. No.: 132,404

[22] Filed: Mar. 21, 1980

[51] Int. Cl.[3] ..... B28C 5/18

[52] U.S. Cl. ..... 366/60; 366/63; 474/84

[58] Field of Search ..... 366/47, 48, 60, 63, 366/185, 232; 474/84

[56] References Cited

U.S. PATENT DOCUMENTS

| | | | |
|---|---|---|---|
| 2,186,448 | 1/1940 | Bunnell | 366/185 |
| 2,573,296 | 10/1951 | Arant | 366/47 |
| 2,808,241 | 10/1957 | Beran, Jr. | 366/60 X |
| 2,944,799 | 7/1960 | Larson | 366/60 X |
| 4,124,304 | 11/1978 | Suganuma | 366/60 |

FOREIGN PATENT DOCUMENTS

| | | | |
|---|---|---|---|
| 589280 | 3/1959 | Italy | 366/60 |
| 775904 | 5/1957 | United Kingdom | 366/48 |
| 902253 | 8/1962 | United Kingdom | 366/48 |
| 1517535 | 7/1978 | United Kingdom | 366/60 |

*Primary Examiner*—Philip R. Coe

*Attorney, Agent, or Firm*—Pearne, Gordon, Sessions McCoy & Granger

[57] ABSTRACT

A concrete mixer drive for a hand wheeled barrow type of mixer, the drive comprising an electric motor mounted on the main supporting bearing of the mixer bowl, and a multiple reduction belt drive from the motor to a pinion driving the main bowl.

3 Claims, 4 Drawing Figures

DRIVE ARRANGEMENT FOR CONCRETE MIXERS

This invention relates to an improved drive arrangement for concrete mixers, more particularly of the mobile or barrow type mixer where the barrow mixer is wheeled to the place where the concrete is desired and then tipped in order to discharge the concrete from the bowl of the mixer.

BACKGROUND OF THE INVENTION

Such concrete mixers are usually hand operated by there being a handle on the bowl so that it is manually turned, the bowl being mounted on a framework similar to a wheel barrow having one or more wheels at the front and a pair of handles at the rear. The concrete is thus hand mixed, and then the mixer is wheeled to the point of discharge for discharging the concrete by lifting the mixer by the handles so that the concrete discharges in front of the wheel.

There are also available power driven mixers, either driven by electric motors or internal combustion engines, but these mixers are designed to be stationary during operation, and the bowl is mounted on pivotal supports, so that the bowl can be pivoted from mixing position to a discharge position, the pivoting being such that the drive continues during this action, the mix discharging into a wheel barrow which is then wheeled to the area of placement of the concrete.

However there is a need for a smaller power driven mixer, and thus it is an object of this invention to provide a drive arrangement for a mixer, preferably the drive arrangement being such that it can be fitted to a barrow type mixer to convert a hand driven mixer to a power driven mixer.

SUMMARY OF THE INVENTION

It is also an object of this invention to provide a drive arrangement which can be fitted to a mixer for sale with the mixer, or can be purchased separately from the mixer to be fitted at a later stage.

Thus there is provided according to the invention a drive arrangement between a driving motor and a shaft adapted to drive a concrete mixer, said drive arrangement comprising a multiple stage reduction between the driving motor shaft and the drive shaft, said drive reductions being provided by a plurality of belts acting directly between the two shafts and respective fast and loose pulleys.

DESCRIPTION OF THE PREFERRED EMBODIMENT

Figure 1:
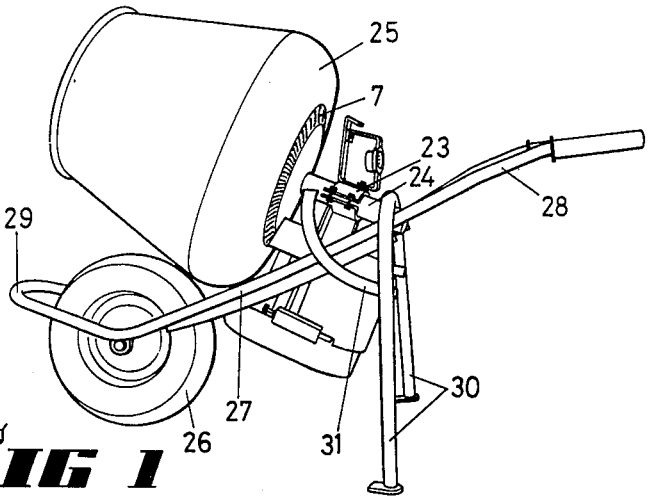
FIG. 1 is a perspective view of the mixer having the drive arrangement of the invention with the protective cover removed.
Figure 2:
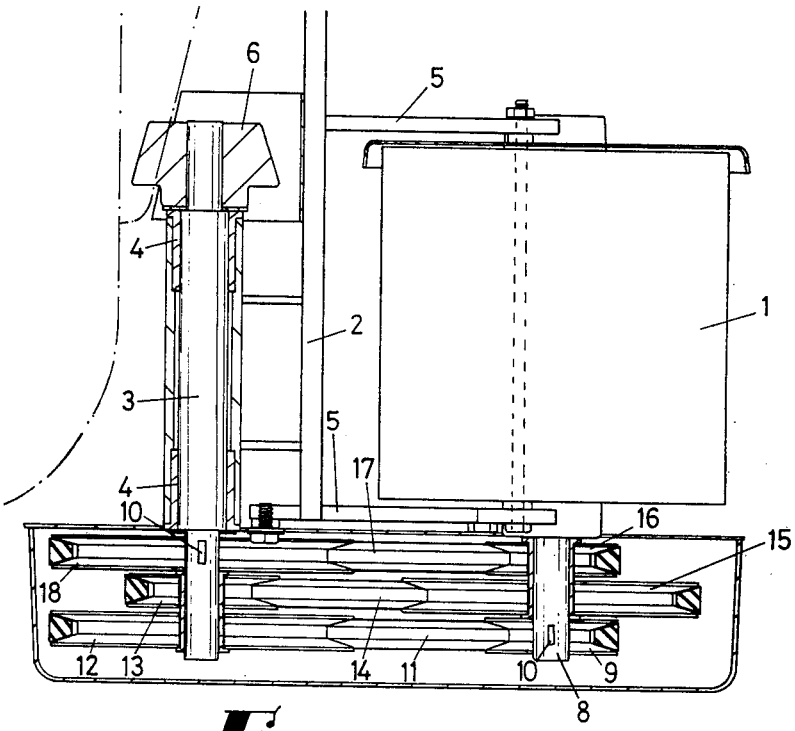
FIG. 2 is a sectional view of the drive arrangement.
Figure 3:
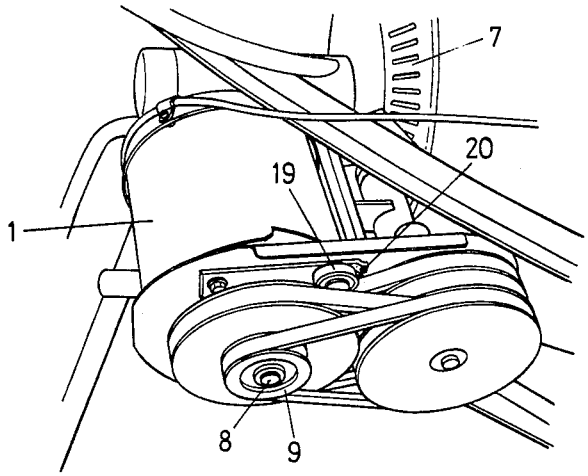
FIG. 3 is a perspective view of the drive.
Figure 4:
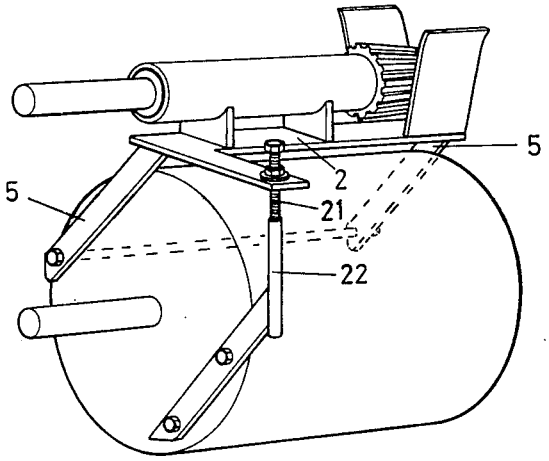
FIG. 4 is a view of the mounting of the motor.

In a preferred form of the invention the driving motor is an electric motor 1 mounted on a framework 2, and the drive shaft 3 is a shaft rotatably mounted in bearings 4 supported by the framework 2, one end of the drive shaft being provided with a bevel gear 6 to engage the bevel gear ring 7 provided on the bowl of the concrete mixer.

The drive shaft 3 and the motor shaft 8 are arranged parallel to each other, with the motor 1 being pivotally mounted on brackets 5 on the framework on one side of the motor, and on the other side of the motor there is provided adjustment acting between the motor 1 and the framework 2 to adjust the motor 1 away from the drive shaft 3 to provide the tension required for the driving belts.

On the motor shaft 8 there is firstly provided a small V-belt pulley 9, fixed fast by a key 10 to the motor shaft 8 which is adapted to drive via the belt 11 a larger diameter pulley 12 freely rotatable on the drive shaft 3. This large diameter pulley 12 is provided either integrally therewith, or has attached thereto a smaller V-belt pulley 13 also rotatable on the drive shaft, which in turn drives by a V-belt 14 a large V-pulley 15 on the electric motor shaft 8, this larger V-pulley on the electric motor shaft being freely rotatable thereon.

Attached to the freely rotatable pulley 15 on the electric motor shaft is a further pulley 16, this preferably being of small diameter, which drives a larger pulley 18 fixed fast to the drive shaft 3 by a key 10. Pulley 18 is driven by belt 17.

Thus it will be seen that there is a three stage reduction, each by the V-belts acting between the two shafts. The adjustment of the belt 17 is by a jockey pulley 19 biased by spring 20 to maintain the tension in this belt, which is required as this is the low speed belt.

The electric motor 1 is pivoted on one side of the motor on a bracket 5, and on the opposite side of the motor 1 an adjusting screw 21 mounted on the framework 2 screws in a socket 22 on the motor, so that by adjusting the screw 21 the tension in the belts can be adjusted. This is sufficient for the fast belts 11 and 14 while the pulley 19 assists in the adjustment of the low speed belt 17.

The framework 2 carries also a clamp 23 positioned such that the clamp is adapted to be fitted over a member of the barrow frame, this preferably being the housing 24 holding the stub shaft of the bowl. The clamp 23 includes four bolts clamping the two portions of the clamp onto the housing 24, the clamp being of sufficient width to support the motor and drive. The electric motor thus is supported and hangs downwardly between and forwardly of the legs of the barrow, with the drive arrangement being at the lower end of the motor. The drive shaft 3 thus passes back upwardly parallel to the motor 1 to engage on the ring gear 7 on the base of the mixer bowl.

As shown in the drawings, the concrete mixer comprises the bowl 25 supported by the housing 24, a shaft (not shown) attached to the base of the bowl being housed in the housing. The housing is rigidly mounted in the mixer frame which is of wheel barrow configuration. The wheel 26 is mounted between the extended arms 27 of the handle 28, the extended arms 27 being joined at 29 to form a nose or rest used when the mixer is tipped to discharge the concrete mix from the bowl 25.

The mixer is supported toward the rear by legs 30 attached to the handles 28, with the housing 24 being rigidly attached to the handles and legs at this locality, a shaped supporting arm 31 on each side being attached to the housing 24 and the legs 30 to rigidly support the housing 24.

The motor and drive unit is thus suspended from the housing 24 and extends downwardly between the legs 30, this being a compact drive unit which can be incorporated in new mixers, or added to existing mixers of this type.

A suitable cover is provided to extend over the upper portion of the motor, and the framework also carries means to connect an electrical power cord to the motor, this preferably being a three pin plug so that a corresponding three pin socket on the end of the power cord can be readily attached thereto.

A suitable switch can if desired be incorporated between the plug and the motor, and alternatively the power can be controlled by the conventional switch on the outlet to which the extension cord is plugged.

It will be seen by this invention that there is provided a compact drive arrangement giving the desired speed reduction between the electrical motor and the drive shaft which meshes by means of a bevel pinion with the ring gear on the base of the mixer bowl, this drive arrangement being light, silent and virtually maintenance free.

By providing the drive arrangement on a small mixer barrow, the output capacity of the barrow is greatly increased with all the advantages of a power driven mixer together with the versatility and manoeuvrability of a barrow mixer.

Although one form of the invention has been described in some detail it is to be realized that the invention is not to be limited thereto but can include various modifications falling within the spirit and scope of the invention.

I claim:

1. A concrete mixer drive arrangement, said mixer including a bowl having a base and an axis of rotation extending through the base, said bowl being supported by a shaft extending from the base of the mixer, a ring gear on said base about the shaft, a drive shaft having a pinion arranged to operably engage said ring gear, an electric motor having a motor shaft, a multiple stage speed reduction operably connected between said motor shaft and drive shaft, said motor shaft extending at a right angle to said axis of rotation, said drive shaft extending parallel to said motor shaft, characterized in that said multiple stage speed reduction comprises a three-stage V-belt drive including pulleys and driving belts, said first stage comprising a pulley fast to said motor shaft driving a pulley loose on said drive shaft, said second stage comprising a pulley loose on said drive shaft and drivingly connected to said first mentioned pulley on said drive shaft driving a pulley loose on said motor shaft, and said third stage comprises a further pulley loose on said motor shaft and drivingly connected to said first mentioned loose pulley on said motor shaft driving a drive pulley fast on said drive shaft.

2. A concrete mixer drive arrangement as defined in claim 1 characterized in that said motor is pivotally mounted on a frame clamped to a housing surrounding said shaft of the bowl of the mixer, and adjustment means to pivotally adjust the motor to adjust the tension in the driving belts, the third stage also including a spring loaded jockey pulley to maintain the tension required for the low speed third stage.

3. A concrete mixer of the power type which includes a bowl rotatably mounted on a framework of a barrow configuration, said bowl having a base and an axis of rotation extending through the base, a ring gear on said base, said barrow including a wheel at a forward end thereof and a pair of handles at a rear end thereof supported by a pair of legs, characterized by a drive arrangement comprising an electric motor mounted adjacent the base of the bowl, said electric motor having a motor shaft extending at a right angle to said axis of rotation of the bowl, a drive shaft parallel to said motor shaft and carrying at one end a pinion engaging said ring gear on the bowl, and at the other end a plurality of pulleys cooperating with a corresponding plurality of pulleys on said motor shaft, V-velts interconnecting the pulleys with each shaft having one fast pulley and two loose pulleys drivingly connected together whereby a multiple speed reduction is provided between the electric motor and the bowl.

* * * * *